US006170440B1

(12) United States Patent
Monnier et al.

(10) Patent No.: US 6,170,440 B1
(45) Date of Patent: Jan. 9, 2001

(54) GAS FIRED BOOSTER

(75) Inventors: Carla A. Monnier, Vandalia; Thomas A. Grueser, Donnelsville; Gary V. Hoying, Sidney, all of OH (US); Lars T. Noren; Doug W. Noren, both of Santa Rosa, CA (US)

(73) Assignee: Premark FEG L.L.C., Wilmington, DE (US)

( * ) Notice: Under 35 U.S.C. 154(b), the term of this patent shall be extended for 0 days.

(21) Appl. No.: 09/311,134

(22) Filed: May 13, 1999

Related U.S. Application Data

(60) Provisional application No. 60/085,367, filed on May 13, 1998.

(51) Int. Cl.[7] ..... F24H 1/43

(52) U.S. Cl. ..... 122/367.1; 122/406.1

(58) Field of Search ..... 122/367.1, 367.2, 122/367.3, 504, 140.1, 406.1; 237/19, 8 R

(56) References Cited

U.S. PATENT DOCUMENTS

| | | |
|---|---|---|
| 54,063 | 4/1866 | Davis et al. . |
| 560,268 | 5/1896 | Laird . |
| 669,738 | 3/1901 | Thomson . |
| 735,683 | 8/1903 | Thomson . |
| 773,927 | 11/1904 | Cleveland . |
| 858,562 | 2/1907 | Bilhorn . |
| 1,239,398 | 9/1917 | Ionides . |
| 1,543,257 | 6/1925 | Greenberg . |
| 1,616,143 | 2/1927 | Schnepp . |
| 1,624,982 | 4/1927 | Rosenberg . |
| 1,632,888 | 6/1927 | Davis et al. . |
| 1,896,648 | 2/1933 | Thomas . |
| 1,912,834 | 6/1933 | Geyer . |
| 2,163,199 | 6/1939 | Hart . |
| 2,213,189 | 9/1940 | Gudmand-Hoyer et al. . |
| 2,291,921 | 8/1942 | Robinson ..... 122/68 |
| 2,483,709 | 10/1949 | Paulsen . |
| 2,614,571 | 10/1952 | Turpin . |
| 2,642,046 | 6/1953 | Alexander . |

(List continued on next page.)

FOREIGN PATENT DOCUMENTS

| | | |
|---|---|---|
| 160378 | 3/1933 | (CH) . |
| 2113076 | 9/1972 | (DE) . |
| 0558334A1 | 9/1993 | (EP) . |

OTHER PUBLICATIONS

Dana Chase Publications, Inc.; *Honing a Specialty*; Jun. 1992.

Notification of Transmittal of the International Search Report or the Declaration, International Application No. PCT/US99/10507, filed May 13, 1999.

*Primary Examiner*—Ira S. Lazarus
*Assistant Examiner*—Sara Clarke
(74) *Attorney, Agent, or Firm*—Thomas Hine & Flory LLP

(57) ABSTRACT

The invention is a gas fired water booster comprising a holding tank, a centrifugal pump, an infrared burner enclosed by a woven ceramic fiber sleeve, a primary and a secondary heat exchanger, and a gas/air supply source. Preferably, the tank and the burner are generally annular in shape and the burner is disposed substantially within the tank. An air/gas mixture is supplied to the burner by a blower and is ignited creating a combustion surface approximately one eighth of an inch above the surface of the woven ceramic fiber sleeve. Water is continuously circulated through the heat exchange system and the burner remains on until a temperature sensor indicates that the water has attained a temperature in the desired sanitizing range. When the booster is turned off the pump continues to pump water through the system for a period of time in order to remove any latent heat from the heat exchange system thereby avoiding vaporization of water left in therein, thus enhancing the life and reliability of the heat exchanger and booster accordingly.

10 Claims, 6 Drawing Sheets

U.S. PATENT DOCUMENTS

| | | | | |
|---|---|---|---|---|
| 2,656,821 | * | 10/1953 | Ray | 122/367.2 |
| 2,674,550 | | 4/1954 | Dunlevy et al. | 134/3 |
| 2,747,590 | | 5/1956 | Ipsen . | |
| 2,753,851 | * | 7/1956 | Lemos, Jr. et al. | 122/367.1 |
| 3,407,025 | | 10/1968 | Hardison | 431/329 |
| 3,585,971 | * | 6/1971 | Muckelrath et al. | 122/140.1 |
| 3,618,572 | | 11/1971 | Nauert . | |
| 3,751,939 | | 8/1973 | Paul . | |
| 3,773,520 | | 11/1973 | Longenecker et al. . | |
| 3,895,607 | | 7/1975 | Johnson . | |
| 3,915,180 | | 10/1975 | Jacobs . | |
| 4,157,706 | | 6/1979 | Gaskill . | |
| 4,298,165 | | 11/1981 | McKinley | 237/8 |
| 4,387,766 | | 6/1983 | Miller | 165/172 |
| 4,439,242 | | 3/1984 | Hadden . | |
| 4,442,779 | * | 4/1984 | Craig et al. | 122/367.3 |
| 4,449,485 | | 5/1984 | Tan . | |
| 4,510,890 | | 4/1985 | Cowan . | |
| 4,519,770 | | 5/1985 | Kesselring et al. | 431/7 |
| 4,541,410 | | 9/1985 | Jatana | 126/362 |
| 4,584,969 | | 4/1986 | Urbani . | |
| 4,597,734 | | 7/1986 | McCausland et al. | 431/328 |
| 4,641,631 | | 2/1987 | Jatana | 126/101 |
| 4,665,984 | * | 5/1987 | Juhàsz . | |
| 4,678,892 | * | 7/1987 | Finger et al. | 122/504 |
| 4,679,528 | | 7/1987 | Krans et al. | 122/367 |
| 4,702,226 | | 10/1987 | Shelley | 126/362 |
| 4,738,394 | | 4/1988 | Ripka et al. . | |
| 4,750,452 | | 6/1988 | Trihey | 122/24 |
| 4,751,914 | | 6/1988 | Jackson | 126/361 |
| 4,766,883 | | 8/1988 | Cameron et al. | 126/351 |
| 4,782,815 | | 11/1988 | Friedman et al. . | |
| 4,810,306 | | 3/1989 | Noren . | |
| 4,823,770 | | 4/1989 | Loeffler | 126/362 |
| 4,852,524 | * | 8/1989 | Cohen . | |
| 4,880,157 | | 11/1989 | Boot et al. . | |
| 4,895,137 | | 1/1990 | Jones et al. | 126/391 |
| 4,993,402 | | 2/1991 | Ripka | 126/361 |
| 5,076,494 | | 12/1991 | Ripka | 237/19 |
| 5,201,807 | | 4/1993 | Liljenberg et al. | 122/18 |
| 5,311,843 | | 5/1994 | Stuart | 122/248 |
| 5,312,521 | | 5/1994 | Fraas et al. . | |
| 5,317,992 | | 6/1994 | Joyce . | |
| 5,357,907 | | 10/1994 | Moore, Jr. et al. | 122/406.1 |
| 5,365,887 | | 11/1994 | Fenn . | |
| 5,365,888 | | 11/1994 | Aronov . | |
| 5,375,563 | | 12/1994 | Khinkis et al. . | |
| 5,435,716 | | 7/1995 | Joyce | 431/7 |
| 5,464,006 | | 11/1995 | Ledjeff et al. | 126/361 |
| 5,494,003 | | 2/1996 | Bartz et al. . | |
| 5,511,570 | | 4/1996 | Noren et al. . | |
| 5,526,776 | | 6/1996 | Fenn et al. | 122/367.3 |
| 5,642,742 | | 7/1997 | Noren et al. . | |

* cited by examiner

GAS FIRED BOOSTER

CROSS-REFERENCE TO RELATED APPLICATION

This application claims the benefit of provisional application Ser. No. 60/085,367, filed May 13, 1998.

BACKGROUND OF THE INVENTION

This invention relates to combustion heaters for water, and more particularly to a booster utilizing an infrared burner for efficiently raising the temperature of water to a desired level for use by a downstream user, generally a commercial warewashing apparatus.

Commercial washing apparatuses, such as conveyor and door type model warewashing or dishwashing machines, generally require water at a temperature of between 120° and 160° F. during washing cycles. This water can generally be obtained cheaply and easily from the central hot water supply of most buildings. Furthermore, keeping the water at this temperature does not usually pose a problem since most warewashers are equipped with a supplemental heating source located in the wash water holding tank in order to keep the water within the desired temperature range for washing.

However, in order to comply with health regulations, warewashing systems that do not utilize a sodium hypochlorite sanitizing system or the like are required to sanitize the ware being washed with a rinse using a minimum of 180° F. water. Furthermore, the use of a 180° F. water rinse is desirable because it facilitates the drying of the ware, thereby decreasing the turnaround time necessary for reuse. This high temperature is generally out of the range available from most buildings central hot water source. Thus, in order to supply water at this desirable temperature, boosters have been employed to raise the temperature of the incoming water from between 110° and 140° F. to the required sanitizing temperature of 180° minimum.

For a typical application, the required water supply rate for a given booster can vary from between 60 to 400 gallons per hour and the required temperature increase can vary from 30° to as much as 80° F., depending on the temperature of the water received from the primary water supply. During busy periods the demand for this water can be quite large, thereby requiring that the booster be capable of continuously supplying a minimum of 180° water at the required final rinse flow rate. Additionally, in order to insure easy installation, equipment of this type is generally subject to certain dimensional restrictions. Typically, the booster will be required to fit under a counter height of approximately 34 inches and within a counter depth of between approximately 25 to 30 inches. Furthermore, a clearance of at least 6 inches is generally required underneath the equipment to facilitate the cleaning of the floor. Further adding to the design constraints for boosters of this type is the fact that they should be simple to operate and easy to maintain. Finally, in order to reduce operating costs, heat losses, other than to the water being heated, need to be kept to a minimum.

Electrically heated booster water heaters are available which generally meet the above requirements. These electric heaters have been attractive to consumers since their initial cost is relatively low and installation is relatively easy. However, heaters of this type are very expensive to operate. Other booster water heaters are known which utilize a blue-flame gas fired heater to supply hot water at the sanitizing temperature. There are many prior art patents for heaters of this type, including U.S. Pat. No. 3,160,145 which discloses a gas fired water heater having a blue flame gas burner at atmospheric pressure disposed below a horizontally mounted finned tube heat exchanger. Heaters of this type are not without problems, though. They are known to produce a noise known as "flame roar" while igniting which can be annoying and distracting to workers. Also, when used to supply sanitizing water at 180°, they are relatively inefficient since in many prior art designs more water is heated to the 180° temperature than is necessary and the remainder is then mixed with cold water to supply primary hot water at 140° to other sources.

Accordingly, boosters have been developed which use high efficiency infrared heaters to heat the water to the desired temperature. An infrared burner is a high efficiency gas burner which is fed an air/gas mixture of a specific concentration. The air/gas mixture flows onto a surface, otherwise known as the combustion surface, where it is ignited. The proportion of the air/gas mixture is preadjusted so that when the burner is ignited a burning zone is maintained at a set level above the combustion surface. Preferably, this burning zone is tuned by adjusting the gas/air flow rate and the back pressure such that burner performance and heat transfer are optimized. For example, U.S. Pat. No. 5,201,807 to Liljenberg et al. discloses the use of such an infrared burner in a water booster for a commercial warewasher. The Liljenberg invention includes a pump which continuously pumps water to be heated through a finned tube heat exchanger which is disposed in close proximity with the burner combustion surface.

SUMMARY OF THE INVENTION

In accordance with the present invention, a gas fired booster is provided which is very efficient, thereby reducing annual operating costs of the booster over prior systems. In particular, the gas fired booster of the present invention provides an infrared burner disposed within a heat exchanger which is substantially enclosed by a water storage tank. The gas fired burner of the present invention fits acceptably under a counter, as is generally required for such equipment, is easy to install and operate, and is inexpensive to maintain. In a preferred embodiment, the infrared burner includes a hollow tube which is covered by a woven ceramic fiber sleeve. An air/gas mixture is fed to the burner through the hollow tube and then through the interstices of the woven ceramic fiber sleeve where ignition occurs on a surface thereof. The burner is encircled by a heat exchanger, preferably of the coiled finned tube type, which is connected to a water inlet. Water flows through the heat exchanger thereby receiving heat from the burner before exiting to an outlet pipe which is connected to the holding tank. Preferably, the heat exchanger is surrounded by the holding tank and hot air and exhaust gases from the burner are allowed to permeate through the heat exchanger to contact the surrounding holding tank before being vented to the atmosphere.

The booster of the present invention is also provided with a pump for continuously circulating water from the holding tank through the exchanger coils to maintain the desired temperature. A temperature sensor is provided which monitors the temperature of the water continuously circulating through the heat exchanger. When a temperature below the desired temperature is sensed, the sensor signals the infrared burner to reignite. This process is repeated continuously while the booster is in an operating stage.

However, in a preferred embodiment, a timer or control loop is provided so that the pump continues to circulate water through the heat exchanger and holding tank for a period of time after the booster is shut down. This is done to avoid vaporizing water left in the heat exchanger, thereby increasing the life of the booster. The pump can continue to operate for a length of time which has been predetermined to sufficiently dissipate the heat from the burner or it can be shut down when the temperature sensor reads a temperature below a predetermined "safe" shutdown temperature.

In a preferred embodiment, the water holding tank completely encircles the primary heat exchanger and the infrared burner disposed within. This design further increases the energy efficiency of the booster by allowing the water in the holding tank to absorb any excess heat given off by the infrared burner that is not transferred to the water in the heat exchanger. Preferably, this tank is annular and insulated to further minimize heat losses. Additionally, in a preferred embodiment, an insulated plug is provided which seals off the end of the primary heat exchanger. This plug increases the efficiency of the booster by increasing the back pressure of the heated gases emanating from the burner and by preventing thermal losses out of the end of the booster.

Also in a preferred embodiment, the gas fired booster is equipped with a vent for flue gases from the infrared burner which outlets to an exhaust cap having at least one side in a heat exchange relationship with the holding tank. This also increases the efficiency of the unit by extracting heat from the hot air and flue gasses prior to their venting to the outside air. The outlet of this exhaust cap then leads to the flue stack.

A principal object of the invention is to provide a water heating booster for a warewasher which is highly reliable, very quiet in operation, easy to install, highly efficient, and relatively low in operating costs. Other objects and advantages of the invention will become apparent from the following description, in which reference is made to the accompanying drawings.

DETAILED DESCRIPTION

Figure 1:
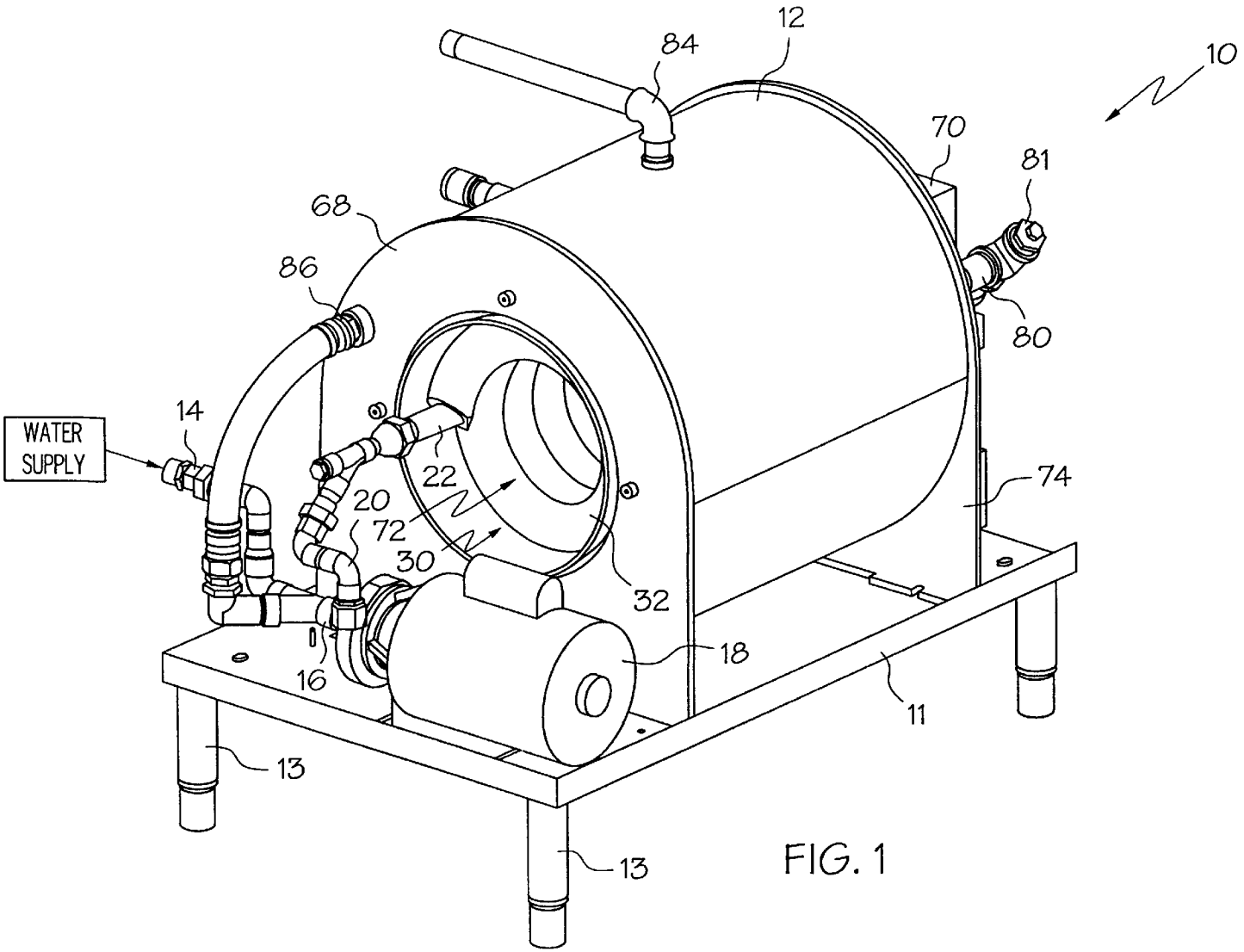
FIG. 1 is a side perspective view of a gas fired booster in accordance with the present invention.
Figure 2:
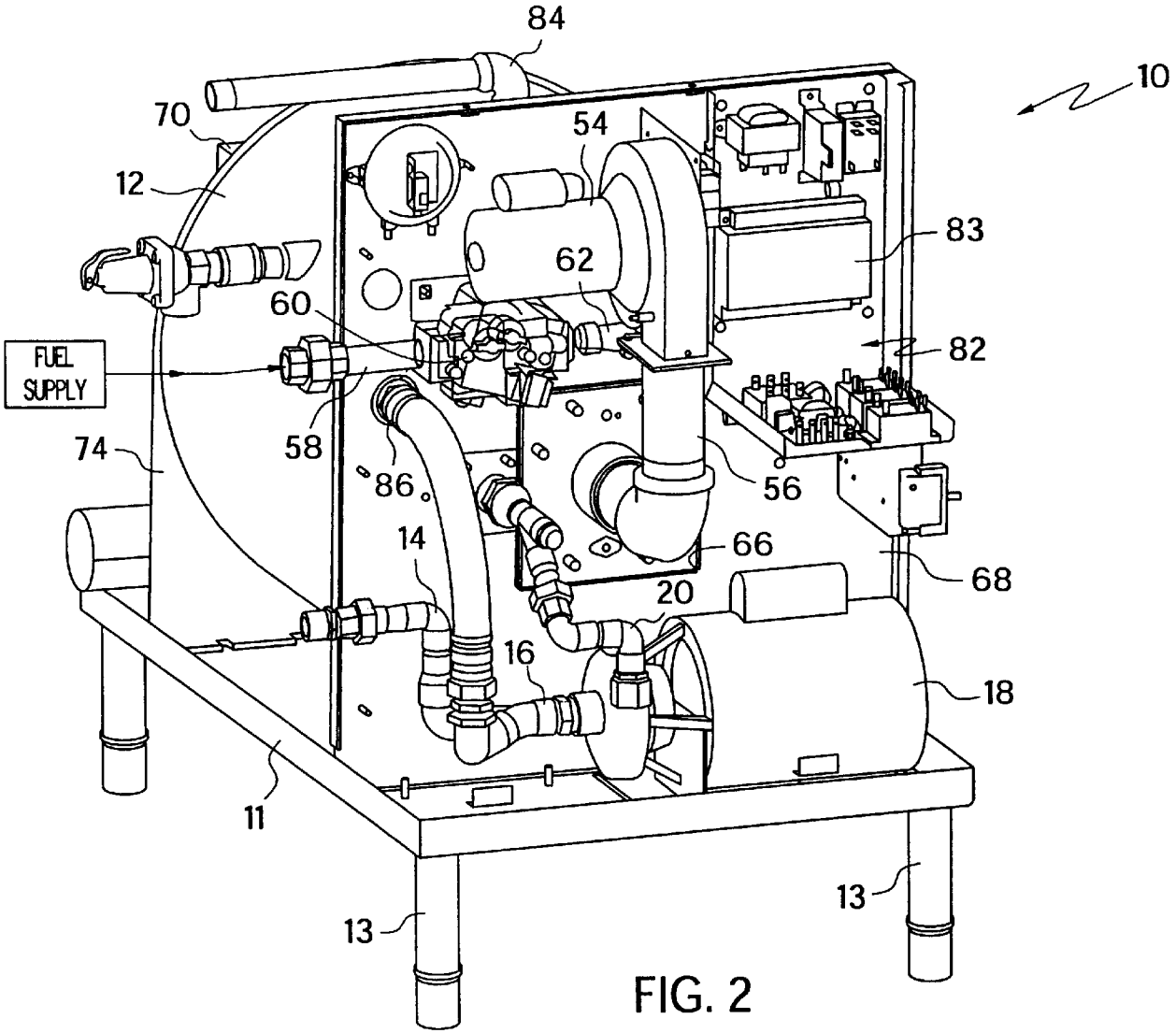
FIG. 2 is a front perspective view of the utility cabinet of the booster of FIG. 1.
Figure 3B:
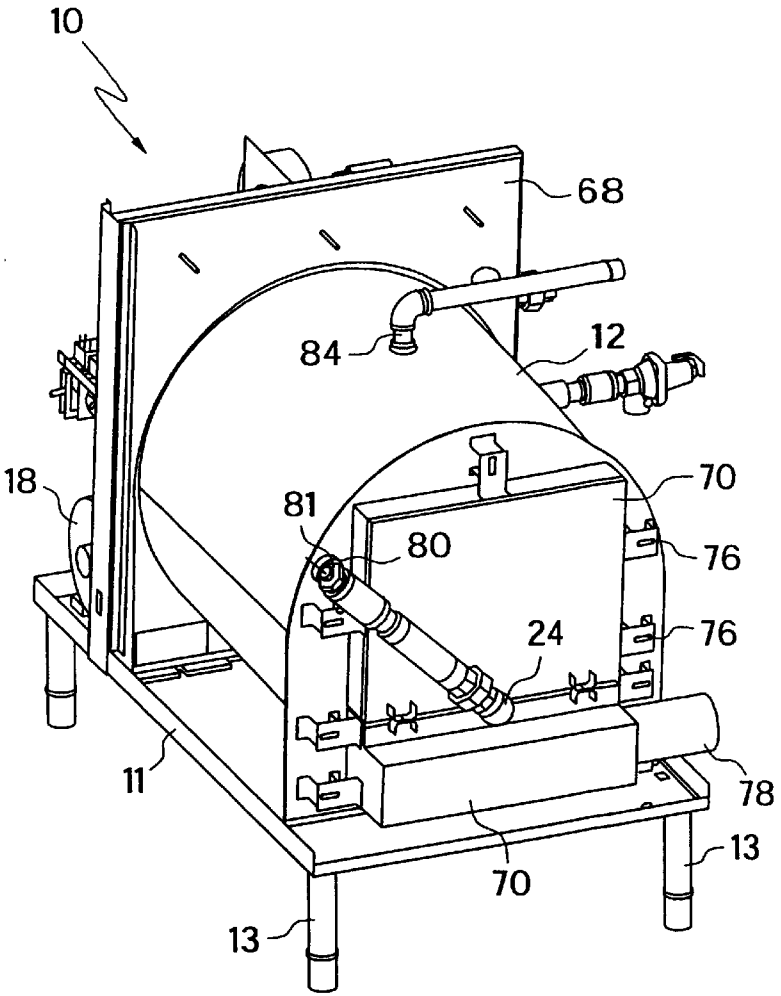
FIGS. 3A and B are rear perspective views of the booster of FIG. 1.
Figure 3A:
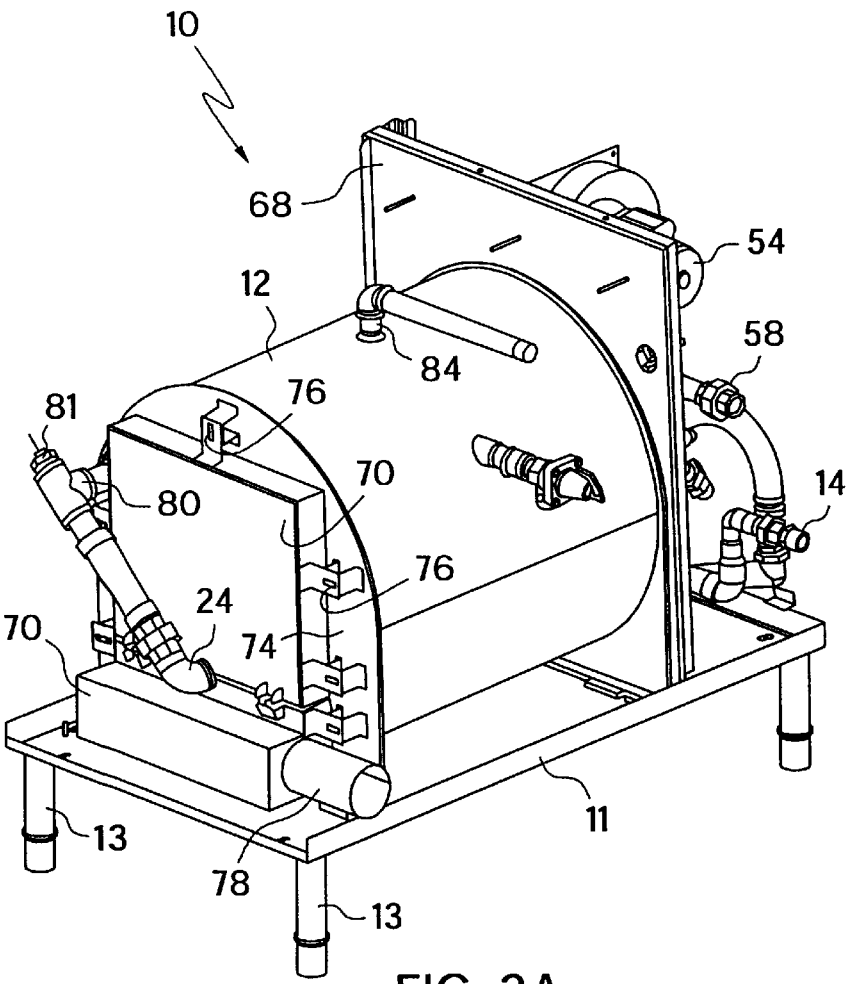

Referring to FIGS. 1, 2, and 3A and B, the gas fired water booster generally designated 10 of the present invention includes a generally annular tank 12 for holding hot water. While a generally annular tank is preferred, the tank may also be other suitable shapes, including saddle shaped, rectangular shaped, etc. The tank is mounted on a frame 11 which is supported by legs 13. Preferably, the legs 13 are at least 6 inches long to facilitate cleaning under the booster 10. Additionally, in order to properly fit under a standard kitchen counter, the booster 10 is approximately 37 inches wide, 22 inches deep, and 32 inches tall. Water is fed to the booster 10 from a water inlet 14 which is connected to the building hot water supply (not shown). The water inlet 14 connects to the inlet 16 of a pump 18. The pump 18 may be chosen from any number of suitable designs, but preferably it is a centrifugal pump as it is in the preferred embodiment described herein. The pump 18 has an outlet 20 which is connected to the inlet 22 for a primary heat exchanger 30 of the gas fired booster 10 of the present invention.

Figure 4A:
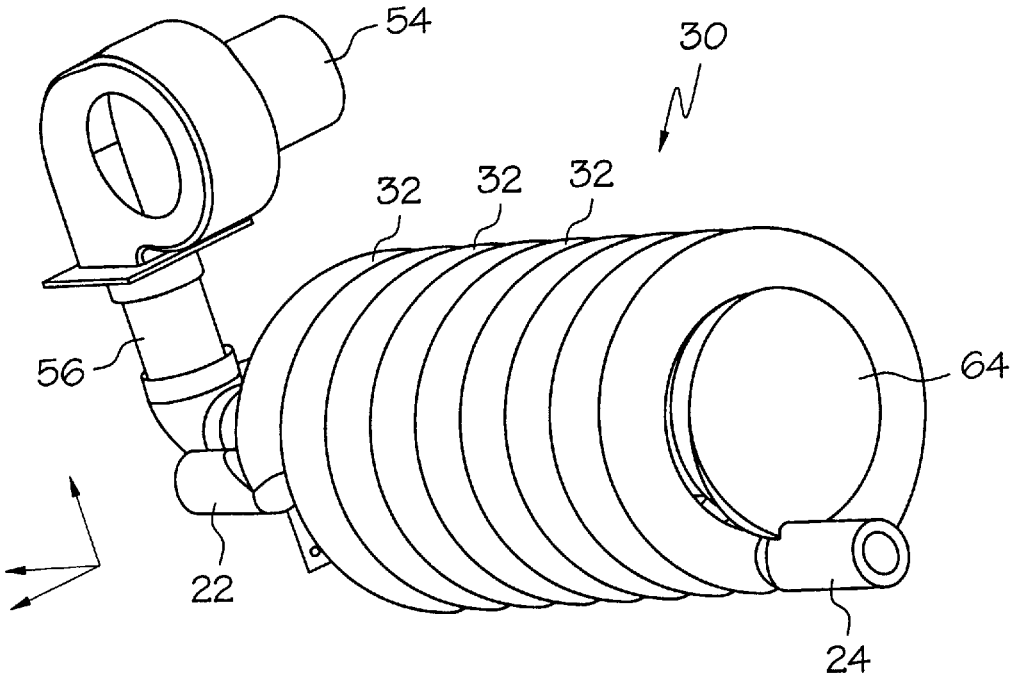
FIG. 4A is a rear perspective view of the coil heat exchanger and infrared burner of the booster of FIG. 1.
Figure 4B:
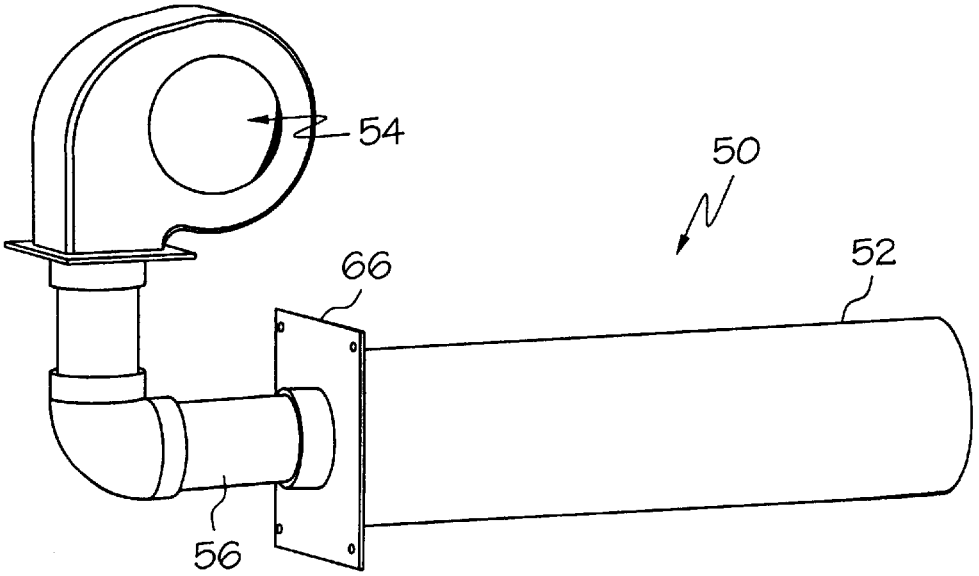
FIG. 4B is a side perspective view of the burner, mixing chamber and blower of FIG. 1.
Figure 5C:
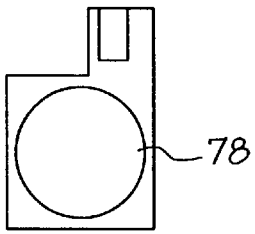
FIG. 5C is a side end view of the exhaust cap of the booster of FIG. 1.
Figure 5B:
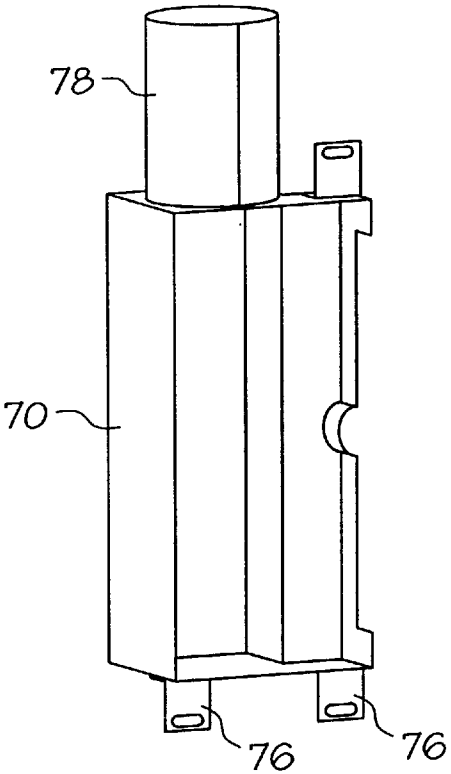
FIG. 5B is a inside perspective view of the exhaust cap of the booster of FIG. 1.
Figure 5A:
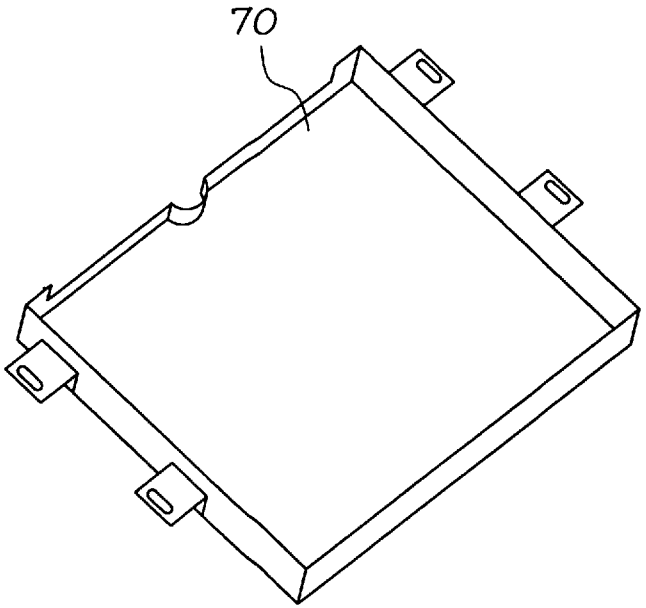
FIG. 5A is a perspective view of the secondary heat exchanger for the flue gas of the booster of FIG. 1.
Figure 6:
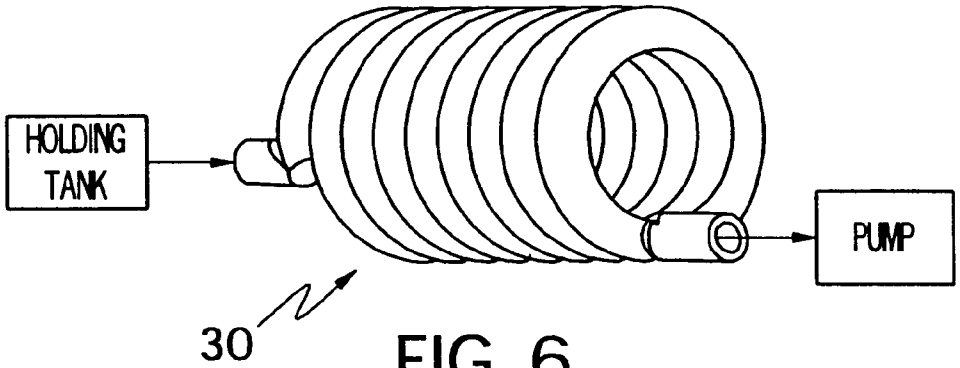
FIG. 6 is a schematic drawing of the heat exchanger in an alternate embodiment of the booster of FIG. 1.
Figure 7:
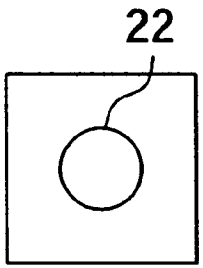
FIG. 7 is a sectional view of a fin on the spiral tube of the heat exchanger in an alternate embodiment of the booster of FIG. 1.

As shown in FIG. 4A, in a preferred embodiment the primary heat exchanger 30 consists of a spiral tube 32 which encircles an infrared burner 50 (see FIG. 4B). Other designs for the heat exchanger may also be used, so long as the water can effectively absorb the heat which is produced by the infrared burner 50. The burner 50 preferably is cylindrical in shape and is rated at a high efficiency level. Burners of this type are produced by Solaronics, Inc. of Rochester, Minn. under Model No. 621622SC.

The burner 50 preferably consists of an inner hollow gas permeable tube (not shown) which is covered by a woven ceramic fiber sleeve 52 which acts as a combustion surface. A means for forcing an air/gas mixture into the burner 50 is provided by a blower 54. The blower 54 is connected to a mixing chamber 56 which is connected to the inlet for the infrared burner 50. A gas line 58 leads from a gas source (not shown) into a gas valve/regulator 60. The outlet gas line 62 from the valve/regulator 60 connects to the mixing chamber 56 and provides gas for the infrared burner 50. When an air/gas mixture is introduced under pressure from the blower 54 and the gas line 62, this mixture flows from the inner tube (not shown) of the burner 50 through the interstices of the woven sleeve 52. Preferably, the infrared burner 50 is used in conjunction with an insulated exhaust plug 64 that is positioned on the distal end of the burner 50 and blocks the open end of the spiral tube 32 of the primary heat exchanger 30. By blocking the open end of the spiral tube 32, the plug 64 increases the back pressure of the heated gases from the burner 50, thereby increasing the efficiency of the booster 10. The exhaust plug 64 can be formed from any suitable insulative material such as a foam or glass fiber mat. The burner is held in place by a face plate 66 which attaches to a mounting wall 68 of the booster 10 of the present invention.

On the back of the infrared booster 10 of the present invention, as best shown in FIGS. 3A and 3B, there is an exhaust cap 70 for capturing the hot air and flue gases emitted from the infrared burner 50. The hot flue gasses exit the enclosed area 72 of the tank through the gaps between the spiral tube 32 of the heat exchanger 30 and are forced out the back of the booster 10, and into the exhaust cap 70. Exhaust cap 70 is held onto the back wall 74 of the booster 10 by brackets 76. After entering the exhaust cap 70, the flue gasses circulate along the back wall 74 of the booster 10, finally exiting through the stack 78 where they are then vented to the atmosphere. By having a secondary heat exchanger such as the exhaust cap 70 disposed on the back wall in addition to the primary heat exchanger 30, the thermal efficiency of the system is increased.

Protruding through the exhaust cap 70 is the outlet 24 from the spiral tube 32 of the primary heat exchanger 30. The outlet 24 is connected to an inlet 80 for the holding tank 12. A temperature sensor 81 is connected in proximity to the inlet 80 and is wired to the ignition control module 83 located on the control board 82. The holding tank 12 is also equipped with an outlet 84 on the top of the tank which is connected to the downstream user of the heated water, namely a commercial warewasher or other user of hot water. Another outlet 86 is provided which protrudes through the mounting wall 68 and joins with the water inlet 14. This connection with inlet 14 allows the pump 18 to continuously circulate the heated water through the primary heat exchanger 30 and back to the tank 12. In this manner, the temperature of the water can be continuously maintained at the desired sanitizing temperature. Although the positioning of the inlets and outlets to the system described herein are those of the preferred embodiment, the important feature is that the water inlet 14, pump 18, heat exchanger 30, and tank 12 are all interconnected. The particular order of these connections may vary, and one of ordinary skill in the art would recognize that if, for example, the outlet 84 to the warewasher and outlet 86 for water recirculation were located on another part of the system rather than the storage tank 12, that these embodiments would still be considered within the scope of the present invention.

The operation of the gas fired booster 10 of the present invention is as follows. The booster 10 is turned on and water enters the system through inlet 14 to the pump 18. The pump 18 forces water through the spiral tube 32 of the primary heat exchanger 30 around the infrared burner 50 and the blower 54 feeds ambient air to the burner 50. The ignition control module 83, upon reading a temperature below the desired setting from the temperature sensor 81, signals the hot surface ignitor (not shown) to activate. Then, the ignition control module 83 signals the valve/regulator 60 to allow gas to enter the mixing chamber 56. The gas/air mixture is introduced to the hollow tube (not shown) of the infrared burner 50 and is ignited on the surface of the woven ceramic fiber sleeve 52 by the hot surface ignitor (not shown). A proof of ignition sensor (not shown) verifies that the burner 50 has been lit within a predetermined period of time. If the proof of ignition sensor (not shown) registers a signal that the burner 50 is not lit, the proof of ignition sensor (not shown) signals the valve/regulator 60 to cutoff gas flow to the mixing chamber 56. The pump 18 operates continuously while the booster 10 is activated to circulate water through the system. Supply water continuously enters the booster 10 through inlet 14 until the holding tank 12 is full and the pressure prevents any more water from entering the system. Thus the booster 10 is full and no more water can be added until a solenoid valve (not shown) on a downstream warewasher or other hot water user (not shown) is opened to release hot water to the user. At this point, the pressure is relieved in tank 12 and make-up water can then resume entering the booster 10 through inlet 14. In this manner the holding tank 12 of the booster 10 of the present invention is continually kept full of water at the desired sanitizing temperature.

Once the infrared burner 50 of the present invention is ignited, hot air and flue gases begin filling the area around the burner 50. Due to the positioning of the exhaust plug 64, these gasses are forced through the gaps in the spiral tube 32 of the primary heat exchanger 30, and into the central tank area 72. The exhaust plug 64 helps to create back pressure for the hot air and flue gasses, thereby increasing the efficiency of the infrared burner 50. Since the mounting wall 68 along with the face plate 66 of the booster 10 seals the front end of the central tank area 72, the gases and hot air are forced back into the exhaust cap 70. Preferably, the exhaust cap 70 covers a substantial area on the back panel 74 of the holding tank 12 so that the gasses may impart as much heat as possible to the holding tank 12 before being forced into the flue stack arrangement 78, where the gases are then vented to the atmosphere.

After the burner 50 has been lit for a sufficient period of time, the temperature sensor 81 indicates that the water continuously flowing through the system has reached the desired temperature and the ignition control module 83 shuts down the infrared burner 50. If the ignition control module 83 does not read a temperature below the desired setting within 30 seconds of the shutdown of the infrared burner 50, the blower 54 is shutdown until the burner 50 is reignited. However, water is still continuously pumped through the booster 10 by the pump 18. Then anytime the temperature sensor 81 indicates a temperature below the desired setting, the ignition control module restarts the blower 54 (if necessary) and re-ignites the burner 50. This process continues as long as the booster 10 remains on.

In a preferred embodiment, when the booster 10 is turned off, the pump continues to run for a predetermined period of time. This is done in order to dissipate latent heat in the heat exchanger 30 thereby avoiding vaporization of any water that is left in the spiral tube 32. This vaporization is detrimental since it decreases the life of the heat exchanger. The operation of the pump 18 can continue for a predetermined period of time, as mentioned above, or it can be shut off when the temperature sensor 81 indicates an acceptable decline in temperature.

While the form of the apparatus herein described constitutes a preferred embodiment of the invention, it is to be understood that the invention is not limited to this precise form of apparatus, and that changes may be made therein without departing from the scope of the invention.

What is claimed is:

1. A gas fired booster for heating water for use by a downstream user comprising:

a water holding tank having an inlet and an outlet;

a water supply for supplying water to be heated for use by a downstream user;

a gas fired infrared burner at least partially surrounded by said holding tank;

a blower for introducing air into said infrared burner;

a fuel supply for supplying a combustible gaseous mixture to said infrared burner;

a heat exchanger having an inlet and an outlet, said heat exchanger being disposed between said burner and said holding tank;

a pump for circulating water through said heat exchanger into said holding tank, said holding tank and said heat exchanger configured so that said heat exchanger inlet is in fluid communication with one of said holding tank and said pump and said heat exchanger outlet is in fluid communication with the other of said holding tank and said pump;

a recirculation loop between said holding tank and said heat exchanger inlet providing fluid communication between said holding tank and said heat exchanger such that said pump can circulate water between said holding tank and said heat exchanger;

and a control operationally coupled to said pump for recirculating water through said heat exchanger following a shutdown of said infrared burner.

2. The gas fired booster of claim 1 wherein said control recirculates water for a predetermined length of time following a shutdown of said infrared burner.

3. The gas fired booster of claim 1 wherein said control further includes a temperature sensor for reading a temperature in said heat exchanger and said control recirculates water until said temperature sensor reads a temperature below a predetermined shutdown temperature.

4. The gas fired booster of claim 1 wherein said control is operationally coupled to said blower, and said control continues operation of said blower for a predetermined period of time following a shutdown of said infrared burner.

5. The gas fired booster of claim 1 further including an exhaust cap for capturing hot flue gases exiting from said burner, said exhaust cap being in primary heat exchange relationship with said water holding tank.

6. The gas fired booster of claim 5 wherein said heat exchanger is a coiled tube disposed between said burner and said holding tank.

7. The gas fired booster of claim 6 further including heat exchange fins positioned on said coiled tube.

8. The gas fired booster of claim 7 further including a permeable outer combustion surface covering said burner to increase said burner's heating efficiency.

9. The gas fired booster of claim 8 further including an insulative plug positioned to block an end of said coiled tube and cause back pressure to heated gases emanating from said burner thereby increasing the efficiency of said burner.

10. The gas fired booster of claim 9 wherein the dimensions of said booster are such that the booster may easily fit under a standard dishwasher loading or unloading table.

* * * * *